US008567654B2

(12) United States Patent
Wu et al.

(10) Patent No.: US 8,567,654 B2
(45) Date of Patent: Oct. 29, 2013

(54) LOCKING MECHANISM OF NAIL GUN

(75) Inventors: I-Tsung Wu, Taipei Hsien (TW); Po-Feng Huang, Taipei Hsien (TW); Yi-Zhuo Zhang, Hongllian (CN)

(73) Assignees: De Poan Pneumatic Corp., New Taipei (TW); Robert Bosch Tool Corp., Mount Prospect, IL (US)

( * ) Notice: Subject to any disclaimer, the term of this patent is extended or adjusted under 35 U.S.C. 154(b) by 389 days.

(21) Appl. No.: 13/021,844

(22) Filed: Feb. 7, 2011

(65) Prior Publication Data

US 2012/0187175 A1 Jul. 26, 2012

(30) Foreign Application Priority Data

Jan. 24, 2011 (TW) ..... 100201531 A

(51) Int. Cl.
*B25C 1/00* (2006.01)

(52) U.S. Cl.
USPC ..... 227/8; 227/120; 227/136; 227/119

(58) Field of Classification Search
USPC ..... 227/8, 120, 136, 119
See application file for complete search history.

(56) References Cited

U.S. PATENT DOCUMENTS

| | | | | |
|---|---|---|---|---|
| 7,000,294 | B2 * | 2/2006 | Kakuda et al. | 227/120 |
| 7,182,236 | B1 | 2/2007 | Wen | |
| 7,513,403 | B2 | 4/2009 | Fujimoto | |
| 2004/0222266 | A1 * | 11/2004 | Kakuda et al. | 227/8 |

* cited by examiner

*Primary Examiner* — Michelle Lopez
(74) *Attorney, Agent, or Firm* — Chun-Ming Shih

(57) ABSTRACT

A locking mechanism for a nail gun includes a side slot formed on a bottom side of a gun body and a nail supplying slot connected to a drive track of the nail gun. A stopper element is formed on a side of a slider element corresponding to the side slot. The gun also includes a magazine in which a nail pusher facing the nail supplying slot and a lockout element facing the side slot are formed. The nail pusher has an ear portion. The lockout element includes a pushing arm and a moveable guide slot capping with the ear portion to restrict the sliding movement of the lockout element on the nail pusher. As the pushing arm extends towards the corresponding end of the nail supplying slot, a nail is pushed into the drive track to shoot. The lockout element enters into the side slot to block the stopper element when the nail is exhausted, so as to enhance the shooting blocking effect of the nail gun.

12 Claims, 7 Drawing Sheets

LOCKING MECHANISM OF NAIL GUN

BACKGROUND

1. Technical Field

The present invention relates to a locking mechanism for a nail gun. More particularly, the present invention relates to a nail pusher slidably formed in a magazine of a nail gun, a lockout element of which the sliding movement on the nail pusher is restricted, and a pushing arm that pushes a nail according to the nail pusher.

2. Related Art

A locking mechanism of a nail gun, namely, an empty-nail shooting blocking mechanism, is to automatically inspect whether the magazine and the drive track are empty when the multiple nails are exhausted while operating a nail gun. The locking mechanism also makes the trigger stay in an invalid pressing and driving state, so that the user cannot drive the shooting action and be reminded to replenish the nails.

The traditional locking mechanism of a nail gun as disclosed in Taiwanese Patent No. 3221044 includes a fixed lockout element formed on a side surface of a nail pusher in a magazine. The stopping member moves to block the slider element together with the nail pusher at a displacement of a thickness of a single nail when the last nail is shot out of the nail gun. The shooting operation is thus stopped. As the thickness of the currently used nail is about 0.6 mm to 1.2 mm, the displacement to block the slider element is only 0.6 mm to 1.2 mm. Therefore, the stopping surface area is insufficient. When the user forces pressing the slider element without knowing that the drive track is empty, the slider element is easily detached from the blocking of the lockout element, so as to affect the shooting blocking effect of the nail gun.

In Taiwanese Patent No. 1283625 and U.S. Pat. No. 7,513,403, a more advanced locking mechanism mounted on a nail pusher that uses a moveable lockout element to stop a slider element is disclosed. A lockout element is slidably formed on a side surface of a nail pusher by resilient force. When the last nail in the drive track is gone, the lockout element resiliently shifts towards the drive track with a displacement larger than the thickness of a single nail, so as to block the movement of the slider element. Consequently, the nail shooting operation of the nail gun is stopped. However, because a sliding gap is respectively formed between the nail pusher and the interior wall of the magazine and between the lockout element and the nail pusher, the nail pusher and the lockout element become loosened after a long operation time. The loosened lockout element is easily stocked in the interior wall of the magazine to affect the smooth operation thereof. Also, the slider element may be possibly detached from the blocking of the lockout element to affect the operation. Besides, both locking mechanisms are not triggered by the existence of last nail(s). Instead, they are actually triggered by the relative location of the slider element and the nail pusher. To make sure it's a zero nail lockout, the slider element has to be sensitive to such as a 0.6 mm movement of the nail pusher in order to not lockout with one nail. This requires very tight tolerance control. To overcome this drawback, U.S. Pat. No. 7,182,236 provides a spring and a lockout element located on the nail pusher.

In Taiwanese Patent No. M269156, a moveable lockout element to block the movement of a slider element is disclosed. A touch element is formed on the nail pusher, and a pendulum lockout element is pivotally formed on the side surface of the magazine. The nail pusher moves towards the drive track with a displacement of the thickness of a single nail when the last nail in the drive track is gone. Thereby, the touch element pushes the lockout element to incline out of the magazine and to the moving path of the slider element, such that the movement of the slider element is blocked. However, when the lockout element inclines out of the magazine, the area to block the slider element is the cross sectional area of the inclination of the lockout element, and a force component is generated because of the inclination, such that the lockout element may be pushed back to the non-blocking position by the safety slid rod. Therefore, the blocking stability to the slider element is affected.

BRIEF SUMMARY

By the current invention, the problems caused by insufficient stopping surface area, high tolerance control and lack of stability are resolved. Also, the problems caused by loosened structure after a long time operation is also overcome, such that the unsmooth blocking ability to the slider element is improved. Besides, the current invention has different structure from U.S. Pat. No. 7,182,236.

The locking mechanism of a nail gun includes a guide plate and a cover plate connected to form a drive track for nail shooting in between. A nail supplying slot and a side slot connected to each other are formed on the guide plate. The nail supplying slot is also connected to the drive track. A containing slot connected to the drive track is formed on the cover plate. A slider element is slidably formed on a side surface of the guide plate. A stopper element is formed on a side of the slider element corresponding to side slot, such that stopper element can move into the side slot along the shooting direction with the slider element. A magazine is formed on a side of the guide plate to contain a column of nails. A nail pusher is slidably formed in the magazine facing the nail supplying slot. A first spring is inserted between the nail pusher and the interior wall of the magazine, so as to impose the resilient force to drive the nail pusher towards the nail supplying slot, such that the column of nails is respectively pushed into the drive track for shooting. The nail pusher includes an ear portion. A lockout element is slideably disposed in the magazine and facing the side slot. A second spring is inserted between the lockout element and the interior wall of the magazine, so as to impose the resilient force to drive the lockout element towards the side slot. A guide slot is formed to moveably cap with the ear portion of the nail pushing slot. The guide slot restricts the sliding motion of the lockout element on the nail pusher along the side slot. A pushing arm is formed at the side of the lockout element and extends towards the corresponding side of the nail slot. The pushing arm pushes the nails into the drive track to move along with the lockout element to detect whether there's nail(s) in the driving track. When the nails are exhausted, the pushing arm enters into the containing slot from the nail supplying slot to drive the lockout element to enter the side slot, so as to stop the stopper element.

By the above structure, the pushing arm pushes the respective nail from the nail supplying slot into the drive track for shooting. The pushing arm can also detect whether the drive track contains any residual nail. The containing slot extends the shifting distance of the pushing arm after the last nail is released, such that the pushing arm can extend beyond the drive track. As a result, the lockout element moves with a distance larger than the thickness of a single nail towards the position to block the movement of the slider element. Therefore, the area of the slider element subject to the stress is increased, the triggering signal from whether there's nail(s) inside the feed channel functions like an on/off signal and triggers a movement much larger than 0.6 mm, and the stability of blocking the movement of the slider element is also improved. In addition, because the lockout element is directly slidably formed in the magazine, the loosening level of the lockout element is effectively suppressed to ensure the blocking stability of the movement of the slider element. Accordingly, the shooting blocking effect of the nail gun is enhanced.

In one embodiment, the guide plate further including a connecting slot connecting the side slot, the nail supplying slot and the drive track, and the containing slot is connected to the connecting slot and the side slot.

The slider element can be pivotally connected to a trigger of the nail gun, such that the slider element can move towards the shooting direction along with the movement of the trigger. Thereby, the trigger is disabled by blocking the slider element.

The ear portion can extends towards the corresponding side of the side slot. The guide slot extends along the side slot to form a shifting distance larger than the length of the ear portion. Therefore, by guiding the guide slot via the ear portion, the lockout element is able to restrict the side sliding motion of the nail pushing slot.

A blocking portion is formed on one side of the side slot near the lockout element. The blocking portion enters into the side slot to stop the stopper element along with the lockout element. The pushing arm extends between the nail supplying slot and the blocking portion of the lockout element.

The second spring drives the pushing arm along with the lockout element to protrude from the top of a pushing claw of the nail pusher.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
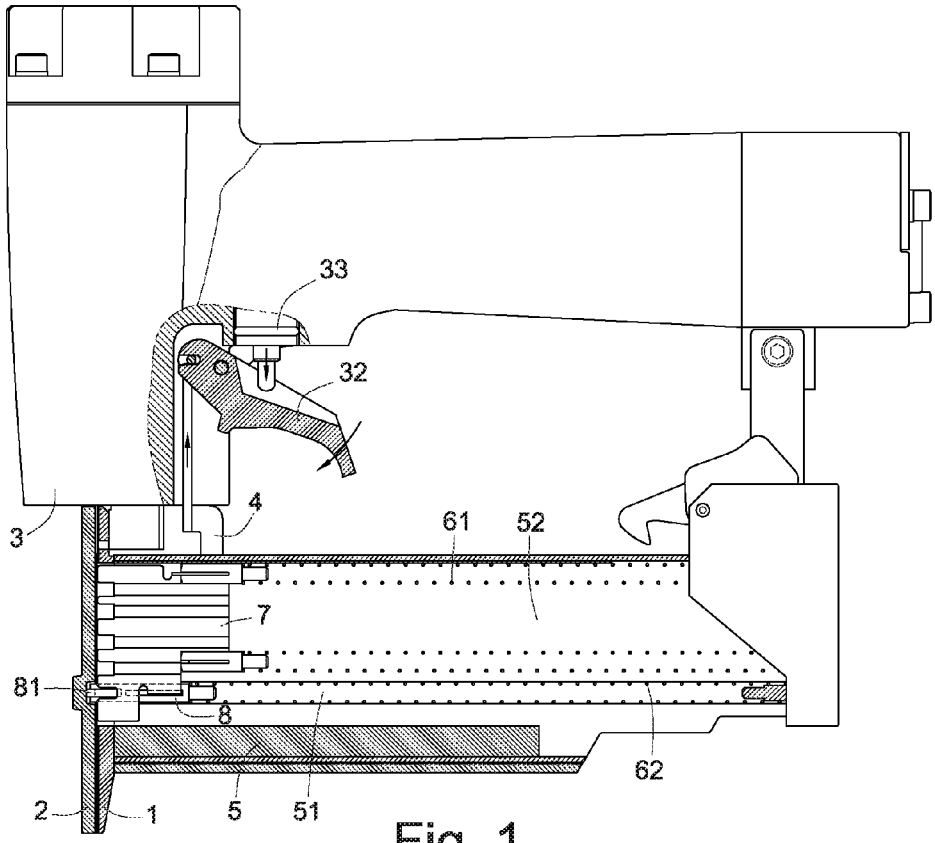
FIG. 1 is a cross sectional view of a preferred embodiment.
Figure 3:
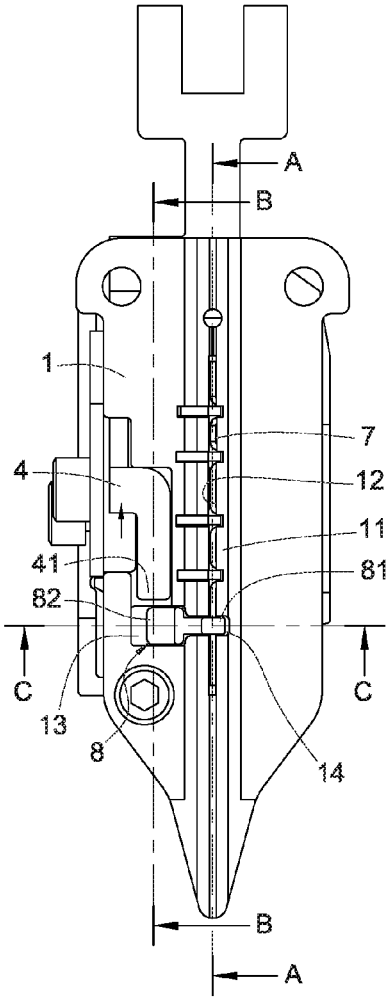
FIG. 3 is a front view of the guide plate.
Figure 5:
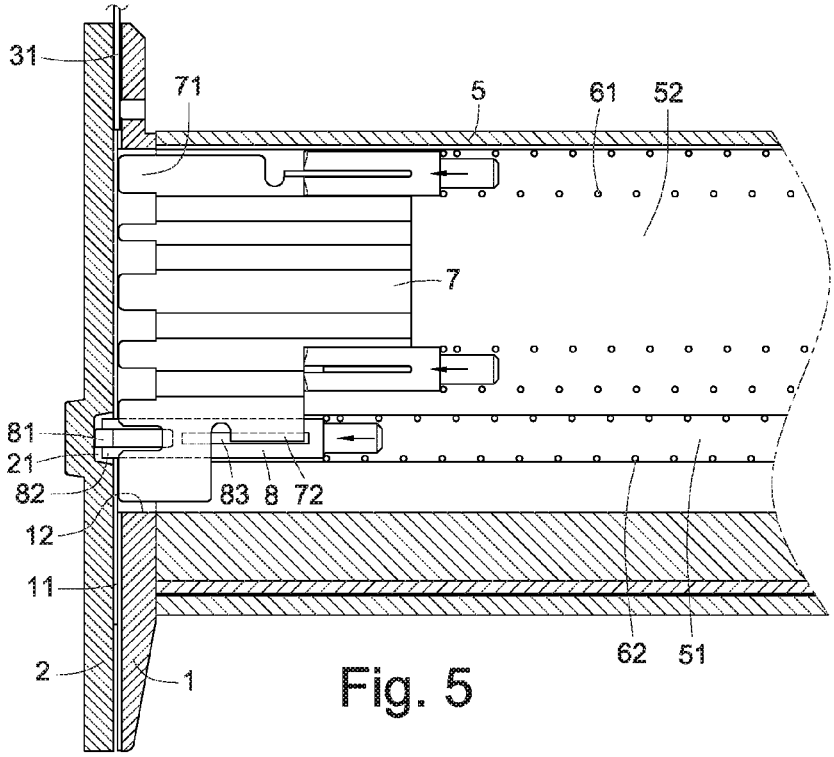
FIG. 5 shows a cross sectional view along Line A-A in FIG. 3.
Figure 9:
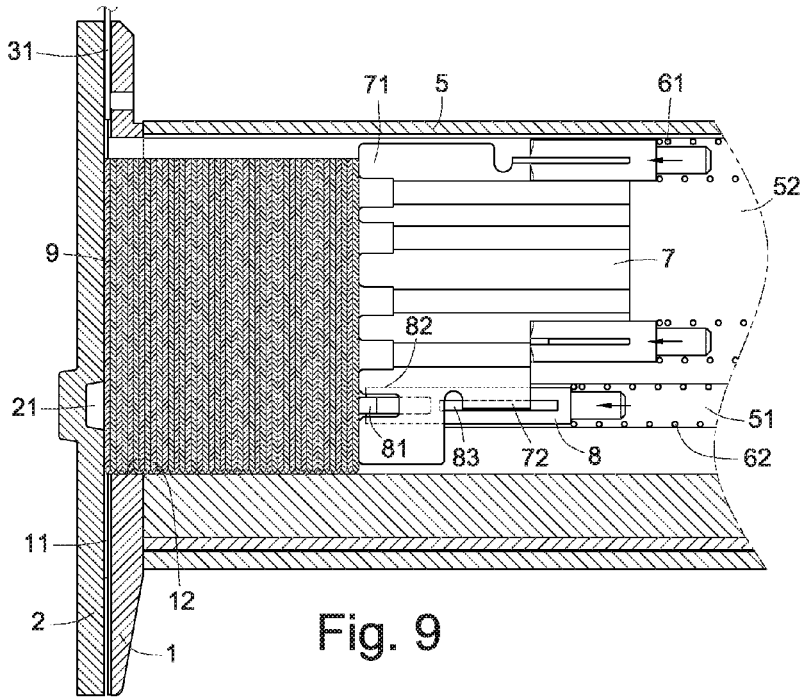
FIG. 9 shows the operation status of the device as shown in FIG. 5.
Figure 11:
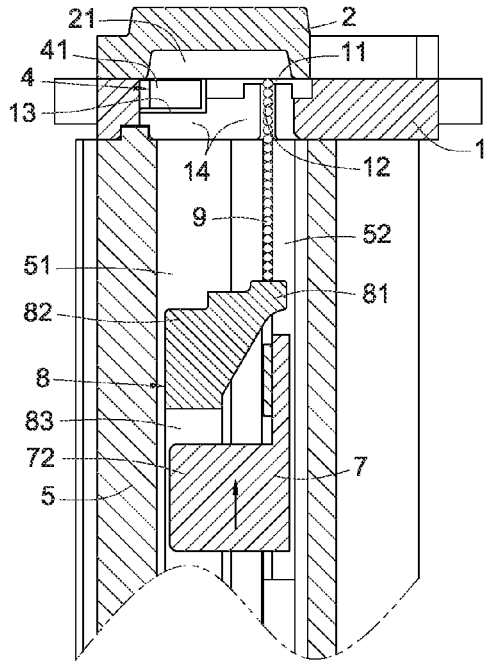
FIG. 11 shows the operation status of the device as shown in FIG. 7.
Figure 12:
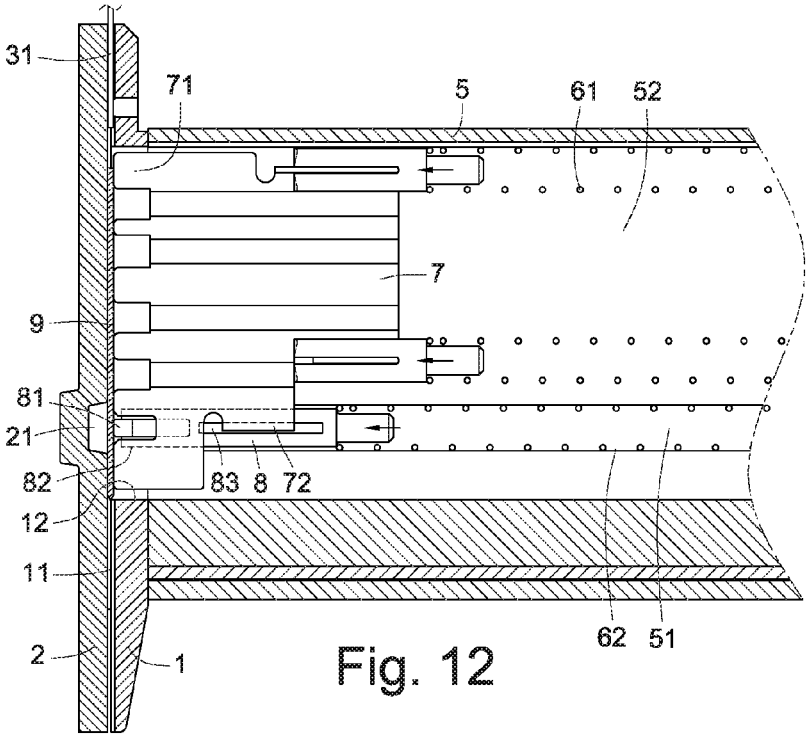
FIG. 12 shows the operation status of the device as shown in FIG. 9.
Figure 13:
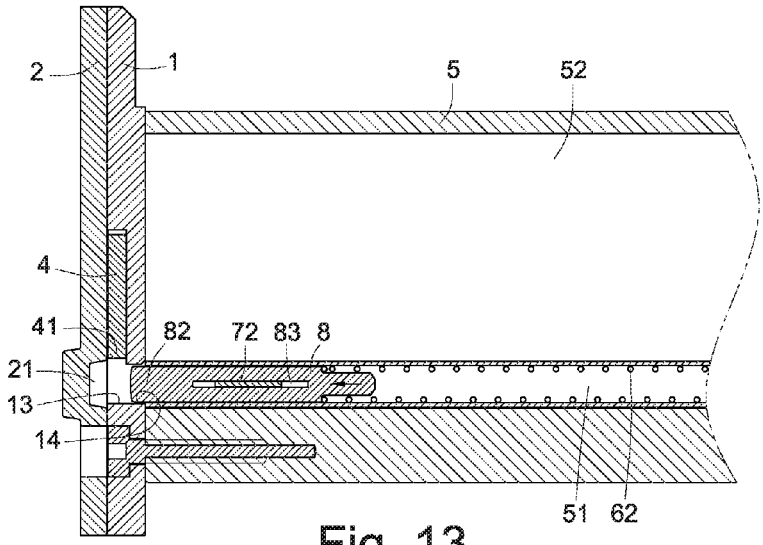
FIG. 13 shows the operation status of the device as shown in FIG. 10.
Figure 14:
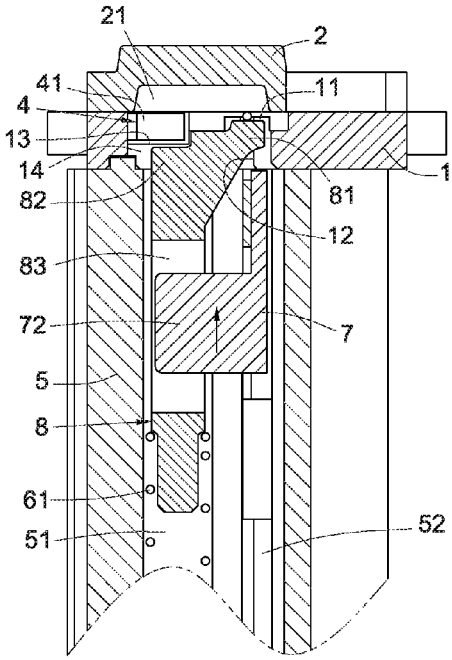
FIG. 14 shows the operation status of the device as shown in FIG. 11.

As shown in FIG. 1, FIG. 3 and FIG. 5, a locking mechanism of a nail gun includes a guide plate 1, a cover plate 2, a slider element 4, a magazine 5, a nail pusher 7, a lockout element 8 and a pushing arm 81. A drive track 11 is formed between the guide plate 1 and the cover plate 2 (as shown in FIG. 9). The gun body 3 includes a nail pushing rod 31 operative to enter into the drive track 11 from the bottom of the gun body 3. The nail pushing rod 31 can also be driven to shoot the nail inside the drive track 11. The drive track 11 can be formed on the surface of the guide plate 1 and a nail supplying slot 12 is formed through the guide plate 1 (as shown in FIG. 11). A side slot 13 is formed on the surface of the guide plate near the nail supplying slot 12. The nail supplying slot 12 is connected to the side slot 13. The nail supplying slot 12 is also connected to the drive track 11. A containing slot 21 connected to the drive track 11 is formed on the surface of the cover plate 2. A connecting slot 14 is formed in the guide plate 1. The connecting slot 14 is connected to the side slot 13, the nail supplying slot 12 and the drive track 11. The containing slot 21 is also connected to the connecting slot 14 and the side slot 13. The containing slot 21 is located at the corresponding side of the drive track 11, the nail supplying slot 12, the side slot 13 and the connecting slot 14.

Figure 2:
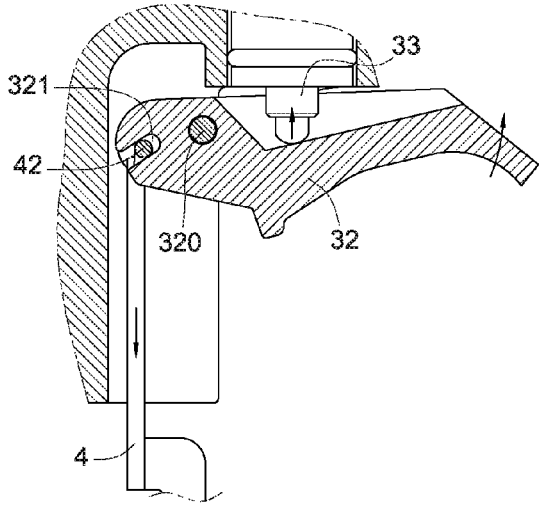
FIG. 2 is a local enlarged cross sectional view of a trigger.
Figure 4:
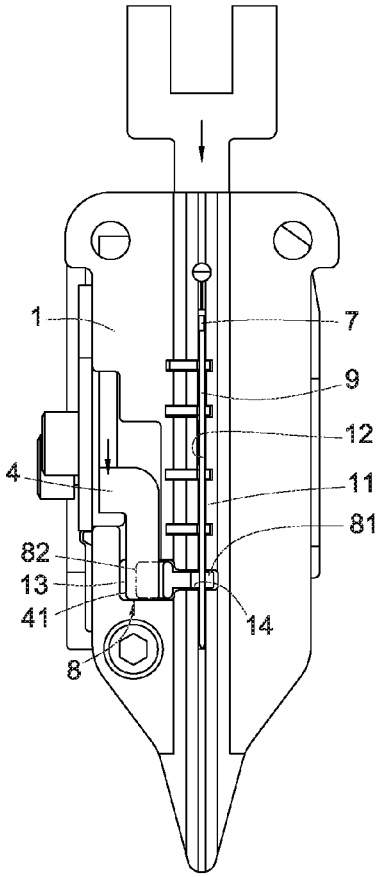
FIG. 4 is shows the operation status of FIG. 3.
Figure 10:
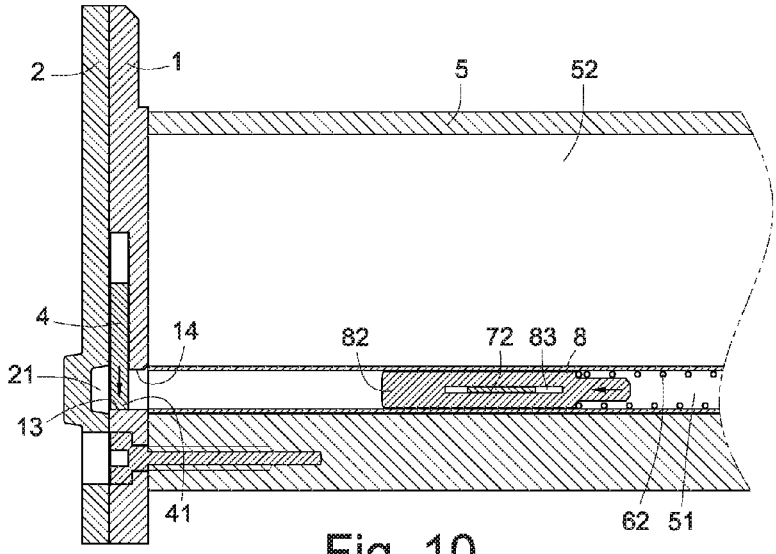
FIG. 10 shows the operation status of the device as shown in FIG. 6.

The slider element 4 is slideably disposed on the side of the guide plate 1 and the cover plate 2 as shown in FIG. 1 and FIG. 3. One end of the slider element 4 extends to form a stopper element 41 (see FIG. 10) at the corresponding side of the side slot 13. The stopper element 41 moves towards the shooting direction to enter into the side slot 13 (as shown in FIG. 4 and FIG. 10). In this embodiment, the stopper element 41 is formed on the bottom side of the slider element 4. A clamping portion 42 is also formed at the top side of the slider element 4 (see FIG. 2). The gun body 3 includes a trigger 32 at a side surface thereof and a valve 33 subject to the movement of the trigger 32. A clamping slot 321 is formed at one side of the trigger 32 near the gun body 3. A pivot 320 of the trigger 32 is located between the clamping slot 321 and the trigger valve 33. The clamping portion 42 of the slider element 4 is pivotally placed in the clamping slot 321 of the trigger 32, such that it can shift along with the movement of the trigger 32 towards the shooting direction. It is appreciated that the slider element 4 pivotally connected to the trigger 32 is only one preferred embodiment. The current invention is not limited to this specific structure. Instead, any device using a slider element to control the shooting of nail is within the scope of the current invention.

Figure 6:
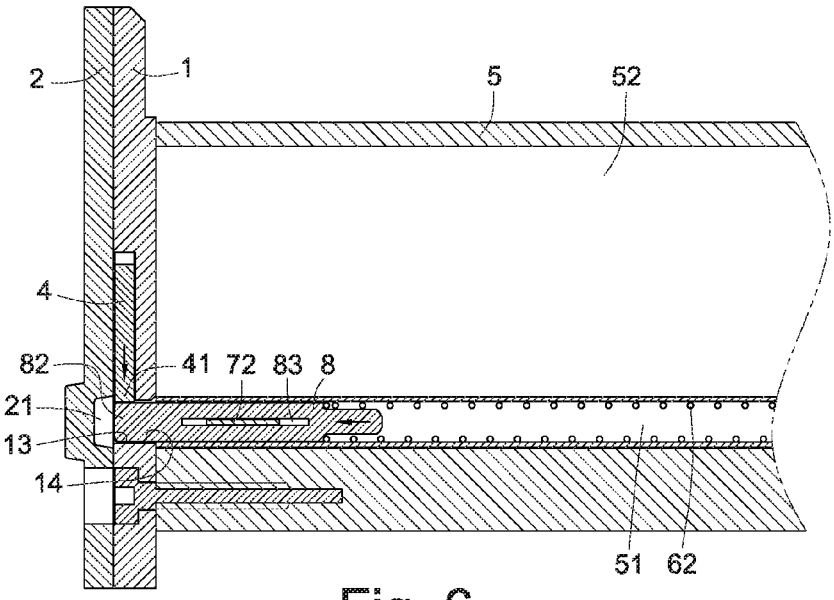
FIG. 6 shows a cross sectional view along Line B-B in FIG. 3.

The magazine 5 is placed at one side of the guide plate 1 (as shown in FIG. 1, FIG. 4 and FIG. 6). The magazine 5 includes a guide slot 51 and a guide channel 52 connected to each other. The guide slot 51 is connected to the connecting slot 14 and the side slot 13 of the guide plate 1 (see FIG. 11). The guide channel 52 is connected to the connecting slot 14 and the nail supplying slot 12 of the guide plate 1 to accommodate the nails 9.

Figure 8:
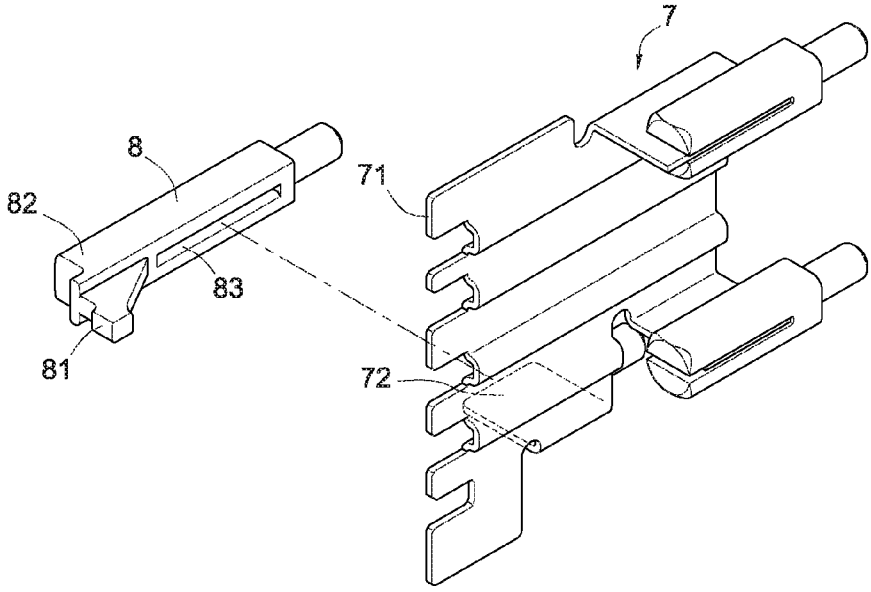
FIG. 8 shows an exploded perspective view of the nail pusher and the lockout element in one preferred embodiment.

The nail pusher 7 is slidably mounted in the guide channel 52 inside the magazine 5 and facing the nail supplying slot 12 (as shown in FIG. 1, FIG. 9 and FIG. 11). A pushing claw 71 (as shown in FIG. 8) operative to push the nails 9 is formed on the side of the nail pusher 7 facing one side of the nail supplying slot 12. A first spring 61 is placed in the guide channel 52 to press against the nail pusher 7 and the bottom interior wall of the magazine 5, such that the top of the pushing claw 71 pushes the respective nails 9 one by one into the drive track 11 for shooting. An ear portion 72 is formed at a side of the nail pusher 7. The ear portion 72 is operative to extend to a corresponding side to the side slot 13 in the form of a sheet along the shifting direction of the nail pusher 7.

Figure 7:
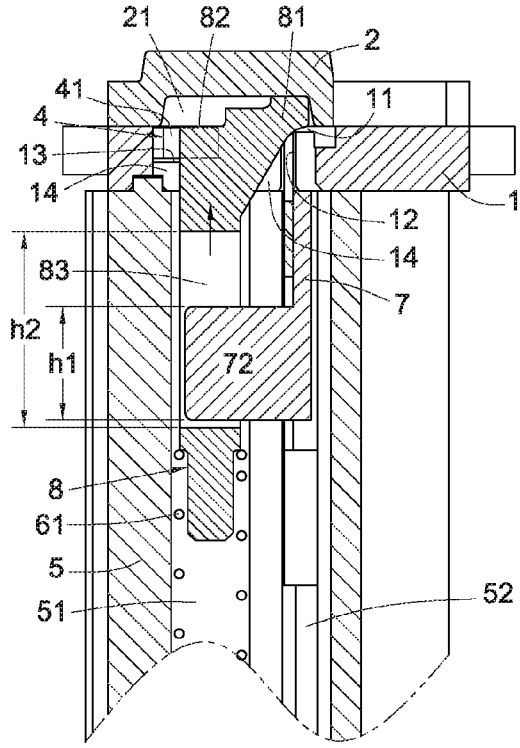
FIG. 7 shows a cross sectional view along Line C-C in FIG. 3.

The lockout element 8 is slidably mounted in the guide slot 51 of the magazine 5 at a position facing the side slot 13 (as shown in FIG. 1, FIG. 9 and FIG. 11). A blocking portion 82 (as shown in FIG. 8) is formed on the side of the lockout element 8 near the side slot 13. A second spring 62 is placed within the guide channel 51 to press against the lockout element 8 and the bottom interior surface magazine 5, so as to impose the resilient force to drive the lockout element 8 towards the side slot 13. A middle section of the lockout element 8 includes a guide slot 83 to moveably cap with the ear portion 83, such that the sliding movement of the lockout element 8 on the nail pusher 7 towards the side slot 13 is restricted. Alternatively, the lockout element 8 is driven to move in an opposite direction. The guide slot 83 extends towards the side slot 13 with a distance h2 larger than the length h1 of the ear portion 72 (as shown in FIG. 7). Thereby, the lockout element 8 can be guided by the ear portion through the guide slot 83 to restrict the sliding motion of the nail pusher 7.

The pushing arm 81 can be formed at a side of the lockout element 8 near the blocking portion 82 (as shown in FIG. 1, FIG. 8 and FIG. 11) and extends towards a side corresponding to the nail slot 13. The pushing arm 81 may be formed at a side of the blocking portion 82 to further extend between the nail slot 13 and the blocking portion 82 of the lockout element 8. Thereby, the pushing arm 81 can move with the lockout element 8 towards the side slot 13, such that the resilient force of the second spring 62 drives the pushing arm 81 to protrude beyond the top of the pushing claw 71 of the nail pusher 8 (as shown in FIG. 5). The pushing arm 81 is thus closer to the drive track 11 compared to the pushing claw 71. Also, the pushing 81 can be subject to the pressure of the nail 9 and withdraw back to the side of the nail pusher 7 (as shown in FIG. 9), such that the pushing arm 81 and the pushing claw 71 can together push the respective nails 9 one by one into the drive track 11. When the nails 9 are exhausted, the pushing claw 71 of the nail pusher 7 itself is operative to move along with the lockout element 8 and enter into the containing slot 21 via the connecting slot 14 and the nail supplying slot 12 (as shown in FIG. 7). The blocking portion 82 is operative to enter into the side slot 13 with the lockout element 8 to block the stopper element 41 (as shown in FIG. 6).

The above structure has provided a precise and sufficient disclosure to enable the current invention. Particularly, the pushing arm 81 that pushes the respective nails 9 from the nail supplying slot 12 one by one into the drive track 11 for shooting and detects whether there is any residual nail within the drive track 11. The containing slot 21 can extend the moving distance of the pushing arm 81 after the last nail 9 is released, such that pushing arm 81 can move beyond the drive track 11. As a result, the lockout element 8 is operative to move with a distance larger than the thickness of a single nail 9 to the blocking position of the slider element 4. Therefore, the area to block the movement of the slider element 4 is increased, and the stability to block the movement of the slider element 4 is enhanced. In addition, the lockout element 8 is directly disposed within the magazine 5, such that the loosening level of the lockout element 8 after a long operation time is effectively reduced. The operation smoothness for blocking the slider element 4 is greatly improved. Accordingly, the effect of the shooting blocking operation is enhanced too. In addition, because the lockout element 8 and the second spring 62 are independently disposed within the magazine 5, the allocation complexity and cost thereof are reduced.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A locking mechanism for a nail gun, comprising:

a guide plate and a cover plate connected with each other and an drive track formed between the guide plate and the cover plate, the guide plate having a nail supplying slot connected to the drive track and a side slot connected with the nail supplying slot, the cover plate having a containing slot connected to the drive track;

a slider element, slidably mounted to a side of the guide plate, the slider element having a stopper element formed at a side thereof corresponding to the side slot, the stopper element being operative to move with the slider element along a shooting direction of nail to enter into the side slot;

a magazine formed at a side of the guide plate to contain a plurality of nails;

a nail pusher having a first engaging portion, the nail pusher slideably formed in the magazine at a position facing the nail supplying slot, and a first spring being placed between the nail pusher and an interior wall of the magazine, so as to impose resilient force to drive the nail pusher towards the nail supplying slot, such that the nails are pushed one by one into the drive track;

a lockout element slideably formed in the magazine at a position facing the side slot, and a second spring being placed between the lockout element and an interior wall of the magazine, so to impose resilient force to drive the lockout element towards the side slot, the lockout element further having a second engaging portion engaged with the first engaging portion, so as to restrict sliding movement of the lockout element towards the side slot at a side of the nail pusher; and a pushing arm formed at a side of the lockout element and extending towards a corresponding side of the nail slot, wherein the pushing arm pushes the nails into the drive track with the movement of the lockout element to detect whether there's nail in the driving track and enters into the containing slot when the nails are exhausted, such that the lockout element is driven to enter into the side slot to block the stopper element.

2. The locking mechanism of claim 1, wherein the guide plate further comprises a connecting slot connecting to the side slot, the nail supplying slot and the drive track.

3. The locking mechanism of claim 2, wherein the containing slot is connected to the connecting slot.

4. The locking mechanism of claim 1, wherein the containing slot is connected to the side slot.

5. The locking mechanism of claim 1, wherein the slider element is pivotally connected to a trigger of the nail gun and operative to move towards the nail shooting direction with the movement of the trigger.

6. The locking mechanism of claim 1, wherein the first engaging portion is an ear portion extending to a corresponding end of the side slot.

7. The locking mechanism of claim 6, wherein the second engaging portion is a guide slot extending with a distance larger than the length of the ear portion towards the side slot.

8. The locking mechanism of claim 1, wherein the second engaging portion being a guide slot extends with a distance larger than the length of the first engaging portion being an ear portion towards the side slot.

9. The locking mechanism of claim 1, further comprising a blocking portion formed at a side of the lockout element near the side slot to enter into the side slot along with the lockout element, so as to block the stopper element.

10. The locking mechanism of claim 9, wherein the pushing arm extends between the nail supplying slot and the lockout element.

11. The locking mechanism of claim 1, wherein the pushing arm extends between the nail supplying slot and the lockout element.

12. The locking mechanism of claim 1, wherein the second spring drives the pushing arm to protrude beyond a top portion of a pushing claw of the nail pusher along with the lockout element.

* * * * *